US005924867A

United States Patent [19]

Lautsbaugh

[11] Patent Number: 5,924,867

[45] Date of Patent: Jul. 20, 1999

[54] COMPUTERIZED ARCHERY AID

[76] Inventor: Deron Lautsbaugh, 150 Neil Rd., Shippensburg, Pa. 17257

[21] Appl. No.: 08/961,506

[22] Filed: Oct. 30, 1997

[51] Int. Cl.[6] ..... F41G 3/32

[52] U.S. Cl. ..... 434/11; 73/167

[58] Field of Search ..... 73/167; 434/11, 434/247; 473/578

[56] References Cited

U.S. PATENT DOCUMENTS

| | | | |
|---|---|---|---|
| 3,824,463 | 7/1974 | Oehler | 73/167 X |
| 3,893,336 | 7/1975 | Tucker | 73/167 |
| 4,845,690 | 7/1989 | Oehler | 73/167 X |
| 5,249,967 | 10/1993 | O'Leary et al. | 434/247 |
| 5,566,951 | 10/1996 | Dart et al. | 473/578 X |
| 5,649,706 | 7/1997 | Treat et al. | 473/578 X |

*Primary Examiner*—John A. Ricci

[57] ABSTRACT

An archery teaching aid is provided including a shooting area. A first camera is mounted to a top wall of the shooting area which is capable of viewing and recording an arrow passing thereby. A second camera is mounted to a side of the shooting area. The second camera is capable of viewing and recording a user and the arrow situated adjacent thereto. Finally, a control mechanism is provided having a display. The computer is adapted for playing back the recordings of the user during use of a bow and further of a top and side view of the arrow during flight.

8 Claims, 2 Drawing Sheets

COMPUTERIZED ARCHERY AID

BACKGROUND OF THE INVENTION

1. Field of the Invention

The present invention relates to bow sight calibrating equipment and more particularly pertains to a new computerized archery aid for providing instructional information regarding the use of a bow and arrow.

2. Description of the Prior Art

The use of bow sight calibrating equipment is known in the prior art. More specifically, bow sight calibrating equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art bow sight calibrating equipment include U. S. Pat. No. 4,598,631; U.S. Pat. No. 4,418,479; U.S. Pat. No. 4,164,901; U.S. Pat. No. 5,090,805; U.S. Pat. No. 5,431,409; and U.S. Pat. No. 4,894,921.

In these respects, the computerized archery aid according to the present invention substantially departs from the conventional concepts and designs of the prior art, and in so doing provides an apparatus primarily developed for the purpose of providing instructional information regarding the use of a bow and arrow.

SUMMARY OF THE INVENTION

In view of the foregoing disadvantages inherent in the known types of bow sight calibrating equipment now present in the prior art, the present invention provides a new computerized archery aid construction wherein the same can be utilized for providing instructional information regarding the use of a bow and arrow.

The general purpose of the present invention which will be described subsequently in greater detail, is to provide a new computerized archery aid apparatus and method which has many of the advantages of the bow sight calibrating equipment mentioned heretofore and many novel features that result in a new computerized archery aid which is not anticipated, rendered obvious, suggested, or even implied by any of the prior art bow sight calibrating equipment, either alone or in any combination thereof.

To attain this, the present invention generally comprises a shooting area with a top wall, bottom wall, a pair of vertical side walls and at least one vertical end wall. A display board is positioned on the end wall and has a square configuration. A front face of the display board has a circle positioned at a central extent thereof and a central spot situated at a center of the circle. Shown in FIG. 1 is a first camera mounted to the top wall. The first camera is focused downwardly and capable of viewing and recording an entirety of the bottom wall for visually recording arrows passing therebeneath. Associated therewith is a second camera mounted to one of the side walls at a central extent thereof. The second camera is capable of viewing and recording an entirety of an opposite side wall and further a user and the arrow situated therebetween. Next provided is a speed detector including a pair of light emitting posts spacedly situated a predetermined distance on the bottom wall between the user and the display board. During use, the speed detector is adapted to calculate a time taken for an arrow to pass between the posts and further calculate a speed of the arrow. A projector is mounted on the top wall of the shooting area adjacent the end wall thereof. The projector functions to project a plurality of vertically aligned spots on the display below the central spot upon the actuation thereof. Finally, a computer is provided having a display and is connected to the cameras, speed detector and projector. In operation, the computer allows a user to play back the visual images collected by the camera. Such images includes the user during use of a bow and further of a top and side view of the arrow during flight. In addition, the computer further serves to actuate the projector upon the receipt of a speed from the speed detector. From such speed, the spacing of the vertically aligned spots for manually calibrating a sight of the bow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new computerized archery aid apparatus and method which has many of the advantages of the bow sight calibrating equipment mentioned heretofore and many novel features that result in a new computerized archery aid which is not anticipated, rendered obvious, suggested, or even implied by any of the prior art bow sight calibrating equipment, either alone or in any combination thereof.

It is another object of the present invention to provide a new computerized archery aid which may be easily and efficiently manufactured and marketed.

It is a further object of the present invention to provide a new computerized archery aid which is of a durable and reliable construction.

An even further object of the present invention is to provide a new computerized archery aid which is susceptible of a low cost of manufacture with regard to both materials and labor, and which accordingly is then susceptible of low prices of sale to the consuming public, thereby making such computerized archery aid economically available to the buying public.

Still yet another object of the present invention is to provide a new computerized archery aid which provides in the apparatuses and methods of the prior art some of the advantages thereof, while simultaneously overcoming some of the disadvantages normally associated therewith.

Still another object of the present invention is to provide a new computerized archery aid for providing instructional information regarding the use of a bow and arrow.

Even still another object of the present invention is to provide a new computerized archery aid that includes a shooting area. A first camera is mounted to a top wall of the shooting area which is capable of viewing and recording an arrow passing thereby. A second camera is mounted to a side of the shooting area. The second camera is capable of viewing and recording a user and the arrow situated adjacent thereto. Finally, a control mechanism is provided having a display. The computer is adapted for playing back the recordings of the user during use of a bow and further of a top and side view of the arrow during flight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
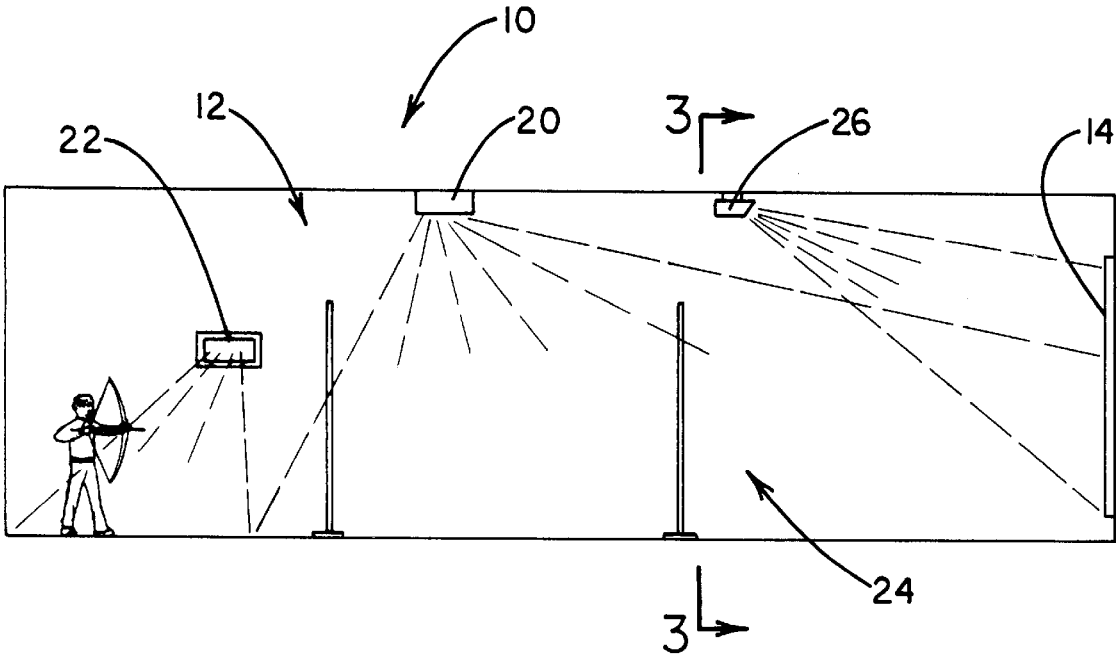
FIG. 1 is a side view of a new computerized archery aid according to the present invention.
Figure 2:
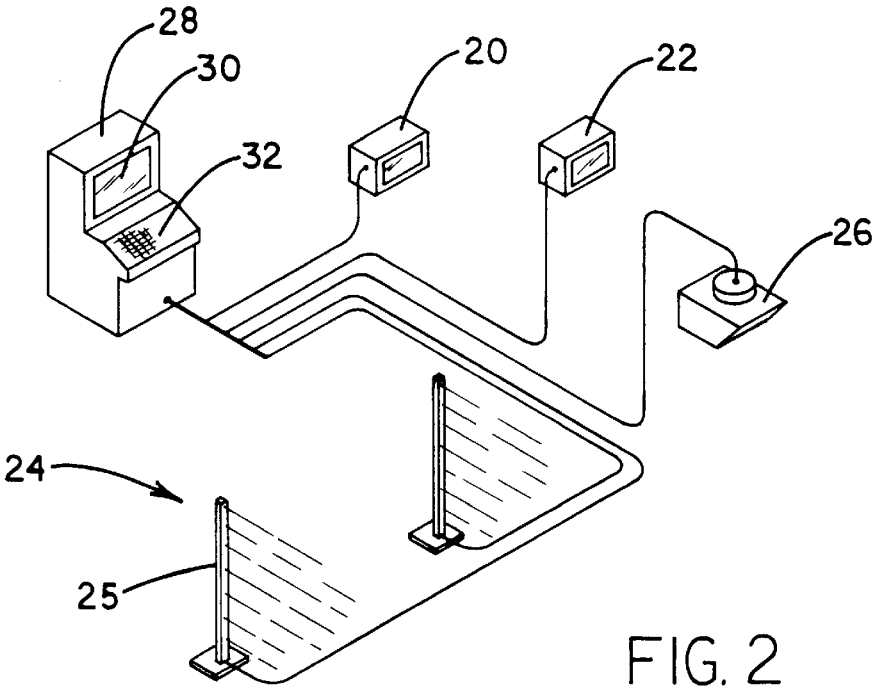
FIG. 2 is a perspective view of the present invention.
Figure 3:
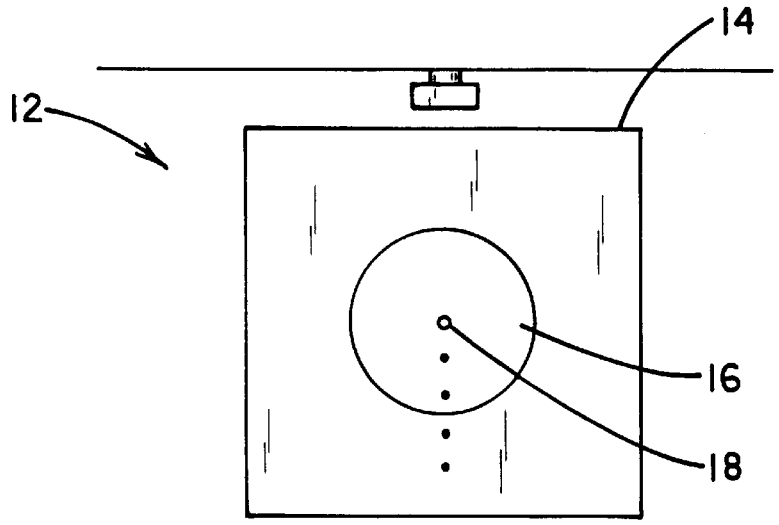
FIG. 3 is a front view of the present invention.
Figure 4:
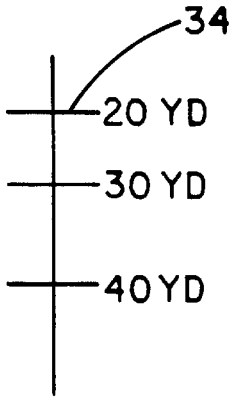
FIG. 4 is an illustration of the sight of the bow of the present invention.

With reference now to the drawings, and in particular to FIGS. 1 through 5 thereof, a new computerized archery aid embodying the principles and concepts of the present invention and generally designated by the reference numeral 10 will be described.

The present invention, as designated as numeral 10, includes a shooting area 12 with a top wall, a bottom wall, a pair of vertical side walls and at least one vertical end wall. A display board 14 is positioned on the end wall and has a square configuration. A front face of the display board has a circle 16 positioned at a central extent thereof and a central spot 18 situated at a center of the circle.

Shown in FIG. 1 is a first camera 20 mounted to the top wall. The first camera is focused downwardly and capable of viewing and recording an entirety of the bottom wall for visually recording an arrow passing therebeneath. As such, the first camera is capable of viewing the entire path of travel of the arrow. This may be accomplished by way of a modified lens or the like. Associated therewith is a second camera 22 mounted to one of the side walls at a central extent thereof. The second camera is capable of viewing and recording an entirety of an opposite side wall and further a user and the arrow situated therebetween.

Next provided is a speed detector 24 including a pair of light emitting posts 25 spacedly situated a predetermined distance on the bottom wall between the user and the display board. During use, the speed detector is adapted to calculate a time taken for an arrow to pass between the posts and further calculate a speed of the arrow. It should be noted that the posts have associated therewith elongated reflectors mounted on a wall opposite the posts. As such, the light rays traverse the traveling path of the arrow and are reflected back to a corresponding detector mounted on the post. This allows a signal to be generated upon the arrow passing before the posts with a timer calculating the time between the signals of each post. Using the relationship between distance and time, the speed of the arrow is determined.

A projector 26 is mounted on the top wall of the shooting area adjacent the end wall thereof. The projector functions to project a plurality of vertically aligned spots on the display below the central spot upon the actuation thereof. The spacing of the vertically aligned spots may be selectively governed, as will become apparent hereinafter. In the preferred embodiment, the projector comprises a primary color TV projector.

Finally, a computer 28 is provided having a display 30 and is connected to the cameras, speed detector and projector. In operation, the computer allows a user to selectively play back the visual images collected by the camera by way of a playback means and forward, reverse and pause controls. Such images includes the user during use of the bow and further a top and side view of the arrow during flight. Which view is displayed may be controlled by the user via a keyboard 32 on the computer. Preferably, the computer is adapted to detect anomalies in the flight of the arrow and indicate the same. For example, any wavering of the arrow during flight may be detected and focused on such that the user may take corrective action. It should be noted that the images collected by the camera are ideally digitized to allow the computer to process the images and detect the deviant motion. Further, the computer is adapted to give instructional information regarding any anomalies detected or concerns entered via the keyboard.

Figure 5:
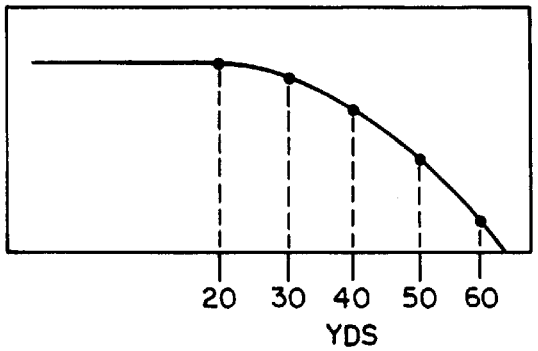
FIG. 5 is a pictorial representation of the data which the computer calculates using the speed of the arrow.

In addition, the computer serves to actuate the projector upon the receipt of a speed from the speed detector. In the alternative, a conductive grid may be mounted on the display to initiate the operation of the projector upon the detection of an arrow striking the display. In such embodiment, the grid may further be employed for scoring purposes. From the calculated speed and predetermined distance from the user to the display, the spacing of the vertically aligned spots are calculated for manually calibrating a sight of the bow. Such spacing represents the vertical component of samples taken from data, as shown in FIG. 5, which is calculated by the computer. To calibrate the sight of the bow, the top distance bar 34 of the sight is aligned with the central spot and the remaining distance bars are adjusted to align with the spots on the display. It should be noted that additional parameters such as arrow size, type, drag etc. may be entered into the computer and incorporated in the calculation of the spacing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An archery teaching aid comprising, in combination:

a shooting area with a top wall, a bottom wall, a pair of vertical side walls and at least one vertical end wall;

a display board with a square configuration mounted to the end wall, a front face of the display board having a circle positioned at a central extent thereof and a central spot situated at a center of the circle;

a first camera mounted to the top wall and focused downwardly and capable of viewing and recording an entirety of the bottom wall for visually recording arrows passing therebeneath;

a second camera mounted to one of the side walls at a central extent thereof, the second camera capable of viewing and recording an entirety of an opposite side wall and further a user and the arrow situated therebetween;

a speed detector including a pair of light emitting posts spacedly situated a predetermined distance on the bottom wall between the user and the display board, the speed detector adapted to calculate a time taken for an arrow to pass between the posts and further calculate a speed of the arrow;

a projector mounted on the top wall of the shooting area adjacent the end wall thereof for projecting a plurality of vertically aligned spots on the display below the central spot upon the actuation thereof;

a computer having a display and connected to the cameras, speed detector and projector, the computer adapted for playing back the visual images of the user during use of a bow and further of a top and side view of the arrow during flight, the computer further adapted to actuate the projector upon the receipt of a speed from the speed detector and calculate the spacing of the vertically aligned spots for manually calibrating a sight of the bow.

2. An archery teaching aid comprising:

a shooting area;

a first camera mounted to a top wall of the shooting area capable of viewing and recording an area therebeneath for visually recording an arrow passing thereby;

a second camera mounted to a side of the shooting area, the second camera capable of viewing and recording a user and the arrow situated adjacent thereto;

control means having a display and connected to the cameras, the control means adapted for playing back the recordings of the user during use of a bow and further of a top and side view of the arrow during flight;

a speed detector adapted for detecting a speed of an arrow moving thereby and a projector for projecting a plurality of vertically aligned spots on a display, wherein the control means includes a computer further adapted to calculate the spacing of the vertically aligned spots from the speed of the arrow and a distance between the display and a point from which the arrow is shot for manually calibrating a sight of the bow.

3. An archery teaching aid as set forth in claim 2 wherein the speed detector includes a pair of ray-emitting posts.

4. An archery teaching aid as set forth in claim 2 wherein the display has a central spot positioned thereon.

5. An archery teaching aid as set forth in claim 2 wherein the control means is adapted to provide the user with instructional information regarding the use of the bow and arrow.

6. An archery teaching aid comprising:

a shooting area;

a speed detector positioned in the shooting area and adapted for detecting a speed of an arrow moving thereby;

a projector for projecting a plurality of vertically aligned spots on a display; and a computer adapted to calculate spacing of the vertically aligned spots from the speed of the arrow and a distance between the display and a point from which the arrow is shot for manually calibrating a sight of the bow.

7. An archery teaching aid as set forth in claim 6 wherein the speed detector includes a pair of ray-emitting posts.

8. An archery teaching aid as set forth in claim 6 wherein the display has a central spot positioned thereon.

* * * * *